US006375004B1

(12) United States Patent
Tuerschmann et al.

(10) Patent No.: US 6,375,004 B1
(45) Date of Patent: Apr. 23, 2002

(54) GOLF BAG WITH PUTTER STORAGE COMPARTMENT

(75) Inventors: Gary L. Tuerschmann, Phoenix; Gregory J. Schmidt; Nip T. Lim, both of Glendale; Herbert E. Haynes, Jr., Phoenix, all of AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/766,431

(22) Filed: Jan. 19, 2001

(51) Int. Cl.[7] ..... A63B 55/00; A63B 55/04; A63B 55/06

(52) U.S. Cl. ..... 206/315.6; 206/315.3; 206/315.2; 206/315.5

(58) Field of Search ..... 206/315.2, 315.3, 206/315.6, 315.5

(56) References Cited

U.S. PATENT DOCUMENTS

| | | | | | |
|---|---|---|---|---|---|
| 2,165,665 | A | * | 7/1939 | Thompson | 206/315.3 |
| 2,595,987 | A | * | 5/1952 | Shears | 206/315.2 |
| 3,530,919 | A | * | 9/1970 | May | 206/315.3 |
| 4,182,391 | A | * | 1/1980 | Kjose | 206/315.3 |
| 4,350,194 | A | * | 9/1982 | Brown | 206/315.3 |
| 4,596,328 | A | | 6/1986 | Solheim | |
| 4,881,638 | A | * | 11/1989 | Cho | 206/315.3 |
| 5,358,109 | A | * | 10/1994 | Nichols | 206/315.3 |
| D372,362 | S | | 8/1996 | Bryant et al. | |
| 5,730,285 | A | * | 3/1998 | Sheehan | 206/315.3 |
| 5,816,396 | A | * | 10/1998 | Shin | 206/315.3 |
| 5,954,255 | A | | 9/1999 | Beebe et al. | |

* cited by examiner

*Primary Examiner*—Lee Young
*Assistant Examiner*—Tri M. Mai
(74) *Attorney, Agent, or Firm*—Darrell F. Marquette

(57) ABSTRACT

A golf bag includes a putter storage compartment which is separate from a main golf club storage compartment and is disposed in an elongated pocket which is normally provided on golf bags and is commonly referred to as a clothing pocket. A partition within the clothing pocket separates the putter storage compartment from the remaining storage area of the clothing pocket. A top fitting having an axial bore is provided in the top panel of the clothing pocket above the putter storage compartment to allow the putter shaft to be inserted and removed from the putter storage compartment. The lower end of the putter storage compartment has an opening formed therein and a baffle is provided which partially restricts that opening to keep the grip end of the putter shaft from falling through the opening. The baffle also serves as a drain for water which may enter the putter storage compartment through the open top thereof. In one embodiment, an elongated tube contains the putter shaft and extends from the top fitting to the bottom opening in the putter storage compartment.

26 Claims, 5 Drawing Sheets

GOLF BAG WITH PUTTER STORAGE COMPARTMENT

BACKGROUND OF THE INVENTION

This invention relates generally to golf equipment and, in particular, to a golf bag having a putter storage compartment that is separate from a main golf club storage compartment.

Golf bags are typically provided with an elongated tubular body in which golf clubs are stored with the body being closed at the bottom and open at the top. The open top of the body is usually provided with a throat structure such as disclosed in U.S. Pat. No. 4,596,328 to J. A. Solheim et al that divides the top into plural sections. The golf clubs are segregated into related groups with each group being placed in a different one of the sections. For example, the driver and fairway woods are normally carried in one section with the high number irons in another section and so forth. The golf clubs are carried in the golf bag with their heads protruding from their respective sections of the open top so as to be visible and thereby aid the golfer in club selection when playing a round of golf The Rules of Golf allow a maximum of fourteen clubs to be carried while playing golf and having the heads of that many golf club heads located immediately above the open top of a golf bag can cause crowding which in turn causes difficulty in club selection, removal and reinsertion. The open tops of most golf bags are relatively small in order to keep the total golf bag weight within practical limits and this is particularly important in golf bags of the type commonly referred to as "carry bags."

Golf club head congestion at the open top of golf bags is particularly troublesome with regard to putters. Putters usually have shorter shafts than other clubs and because of this, when putters are carried in a golf bag, their heads are located closer to the open top of the golf bag than the heads of the other clubs being carried and are often below the heads of many clubs. Such positioning of putter heads makes putter selection and removal more difficult than the selection and removal of other clubs. Since putters may be used more often than any other club during a round of golf some prior attempts have been made to alleviate this problem.

One prior attempt at solving the difficulty associated with the selection and removal of putters from a golf bag is to use a spring clip that is attached to the outside of the open top of the golf bag. The putter shaft is grasped by the spring clip with the putter being suspended from the spring clip so as to lay along the outside of the golf bag. While the use of the spring clip overcomes putter selection and removal problems, the putter shaft is exposed and can come into contact with objects in close proximity to the golf bag and can be easily dislodged from the spring clip.

Another prior attempt to solve the putter selection and removal problem is to configure the divider in the open top of the golf bag to include a distinct section for containment of a putter. This attempt improves putter selection and removal by always locating the putter in the same place. However, the putter head is still located in a congested area at the open top of the golf bag. Therefore, a need exists for a golf bag having a putter storage compartment that is separate from the main golf club storage compartment and which overcomes the problems associated with the above-mentioned prior attempts.

SUMMARY OF THE INVENTION

In accordance with the present invention, a golf bag has a putter storage compartment that facilitates putter selection and removal. In addition to an elongated tubular body which defines a main golf club storage compartment, golf bags are typically provided with one or more zippered pockets on the exterior of the tubular body for carrying golf balls, tees and other accessories needed in playing the game of golf One pocket is primarily intended for carrying clothing such as rain gear, jackets and the like and for that reason it is often referred to as the "clothing pocket." The clothing pocket is elongated and is coextensive with the tubular body extending from proximate the open top to proximate the closed bottom of the body and protrudes from the body. The putter storage compartment of the present invention is located within the clothing pocket of the golf bag so as to extend the full length of the clothing pocket and is preferably in the form of either of the two embodiments discussed below.

In one embodiment, the putter storage compartment is in the form an elongated tube, the upper end of which is connected to the lower end of a top fitting that is carried in a top panel of the clothing pocket. The top fitting opens onto the top panel of the pocket to allow the putter shaft to be inserted and removed from the elongated tube. The lower end of the elongated tube is open and extends through an opening formed in the bottom panel of the pocket. The opening formed in the bottom panel of the pocket is provided with baffle means that keeps the grip end of the putter shaft from extending below the open end of the elongated tube and serves as a drain for water which may enter the elongated tube through the open top thereof The baffle means is formed with a cup shaped pocket into which the lower end of the elongated tube is disposed so as to hold the elongated tube in place. The elongated tube is disposed in a corner of the clothing pocket and is separated from the interior of the clothing pocket by a partition to keep the elongated tube from becoming entangled with the contents of the clothing pocket.

In another embodiment, the putter storage compartment is provided with the top fitting which opens onto the top panel of the clothing pocket and opens downwardly into the putter storage compartment which is an empty space located in the corner of the clothing pocket and separated from the interior of the clothing pocket by the partition. In other words, the elongated tube is omitted in this embodiment. An opening is located in the bottom panel of the clothing pocket and baffle means is located therein for drainage purposes and for preventing the putter from extending from the lower end of the storage compartment. Since there is no elongated tube in this embodiment, the baffle means need not have a cup shaped pocket and instead will be of planar configuration.

DESCRIPTION OF THE PREFERRED EMBODIMENTS

Figure 1:
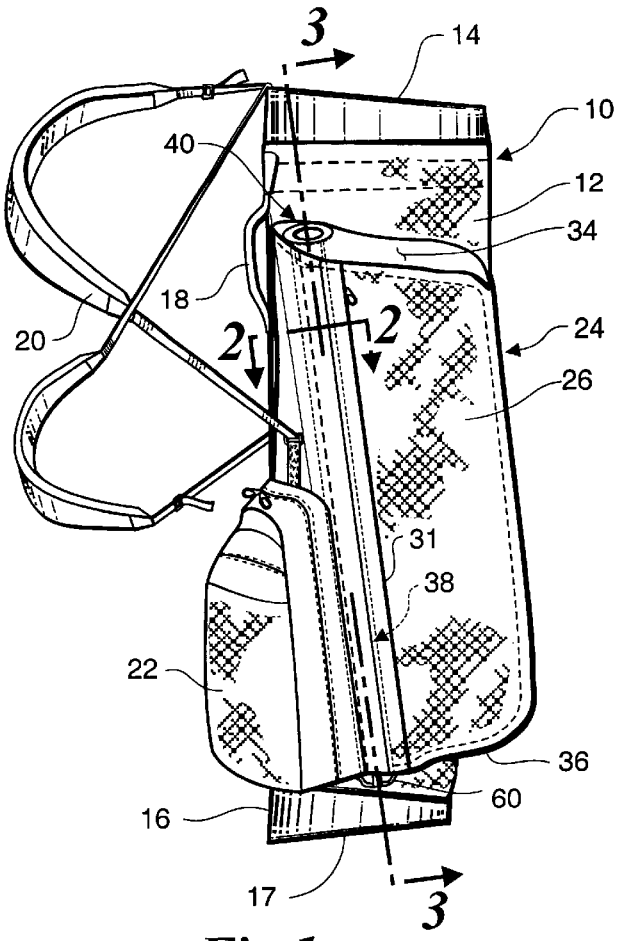
FIG. 1 is a side elevational view of a golf bag incorporating one embodiment of the a putter storage compartment according to the present invention.
Figure 2:
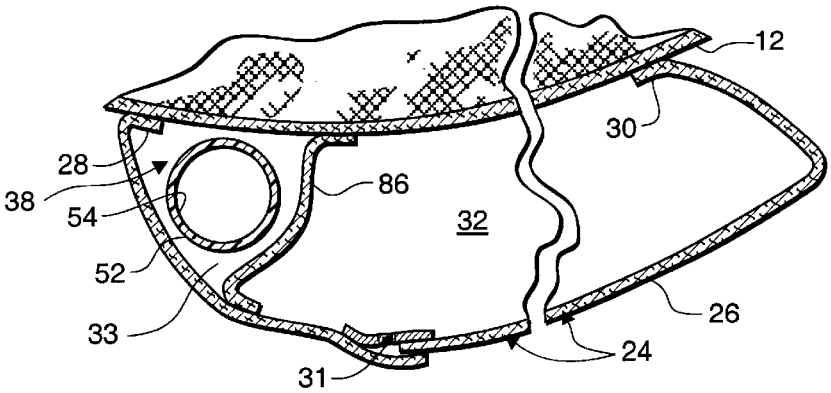
FIG. 2 is an enlarged fragmentary sectional view taken along the line 2—2 of FIG. 1.

Referring more particularly to the drawings, FIG. 1 shows a golf bag according to the present invention which is referred to generally by the reference numeral 10. The golf bag 10 is provided with an elongated tubular body 12 defining a main storage compartment for holding a plurality of golf clubs and having an open top 14 including a throat structure (not shown) such as disclosed in U.S. Pat. No. 4,596,328 through which golf clubs are inserted into and removed from the body 12. The golf bag 10 has a base 16 such as disclosed in U.S. Pat. No. D372,362 to L. J. Bryant et al which provides a closed bottom 17 for the body 12, and further includes a handle 18 and a shoulder strap assembly 20. It will be understood that the shoulder strap assembly 20 may be a conventional single strap, but is preferably of the double strap type as shown and as disclosed in U.S. Pat. No. 5,954,255 to J. N. Beebe et al. The golf bag 10 further includes a small pocket 22 of the type commonly referred to as a "ball pocket" in that it is used to carry spare golf balls and whatever other golf accessories the golfer may need. A large pocket 24 also provided on the exterior of the golf bag 10 is commonly referred to as a "clothing pocket." The clothing pocket 24 is elongated and extends from proximate the open top 14 of the body 12 to proximate the closed bottom 17 of the body 12 and is substantially coextensive with the body 12. The clothing pocket 24 includes a side panel 26 which has its opposite side edges 28, 30 attached to the tubular body 12 along one side thereof as seen in FIG. 2 with the side panel 26 having a zipper 31 and defining an interior storage area 32 in the clothing pocket 24. The clothing pocket 24 also includes a top panel 34 and a bottom panel 36. As will become apparent from the following description, the clothing pocket 24 is especially configured to contain an auxiliary storage compartment of the present invention in a comer 33 of the interior storage area 32 for holding a golf putter, one embodiment of which is identified generally by the reference numeral 38.

Figure 3:
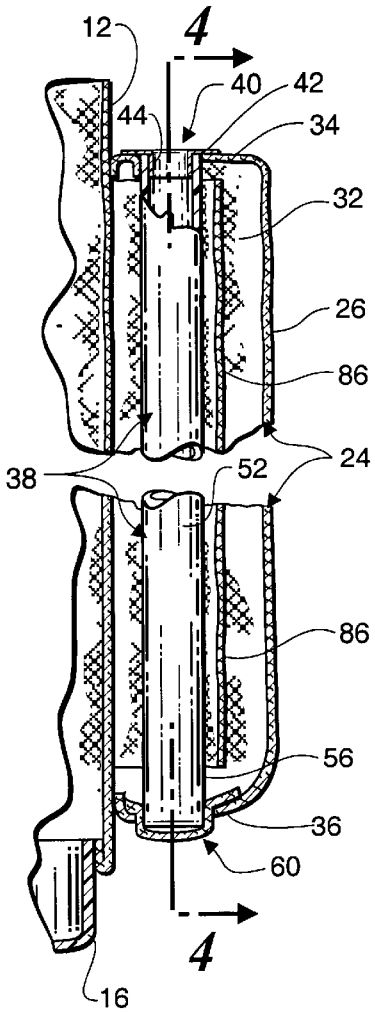
FIG. 3 is a fragmentary sectional view taken along the line 3—3 of FIG. 1.
Figure 4:
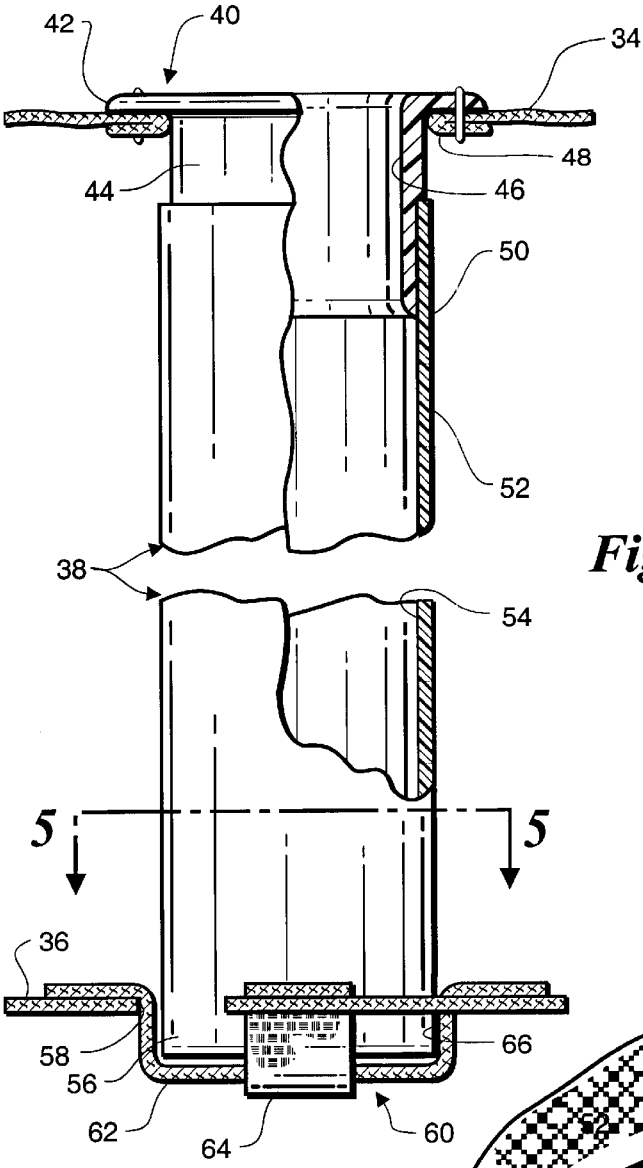
FIG. 4 is an enlarged fragmentary sectional view taken along the line 4—4 of FIG. 3 and partially broken away to show the various features thereof.
Figure 5:
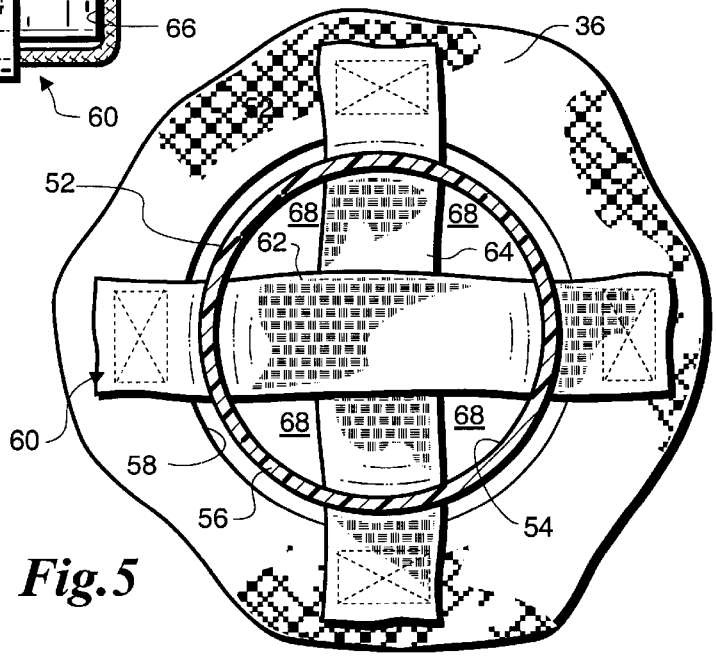
FIG. 5 is an enlarged fragmentary sectional view taken along the line 5—5 of FIG. 4 showing one configuration of baffle means located at the bottom of the putter storage compartment.

As best seen in FIGS. 3 and 4, the auxiliary storage compartment 38 includes a top fitting 40 which is provided with a flange 42 at its upper end and has a depending body 44 with both the flange 42 and the body 44 circumscribing an axial bore 46. The top fitting 40 is mounted in an opening 48 provided in the top panel 34 of the clothing pocket 24 so that the axial bore 46 of the top fitting 40 opens up onto the top exterior surface of the top panel 34. The top fitting 40 is preferably formed of a suitable synthetic resin and is affixed to the top panel 34 such as by sewing. The lower end of the depending body 44 is telescopically mounted within the open top end 50 of an elongated tube 52 which depends from the top fitting 40 down through the interior storage area 32 of the clothing pocket 24. The elongated tube 52 defines a bore 54 which is coaxial with the bore 46 of the top fitting 40 and the open bottom end 56 of the tube 52 is located within an opening 58 formed in the bottom panel 36 of the clothing pocket 24. The opening 58 formed in the bottom panel 36 of the clothing pocket 24 has baffle means 60 located therein with the baffle means 60 being in the preferred form of a pair of straps 62 and 64 that are arranged in a cruciform array as seen best in FIG. 5. The straps 62 and 64 each have their opposite ends stitched at diametrically opposed locations to the interior surface of the bottom panel 36 at locations proximate the hole 58 formed in the bottom panel 36. The straps 62 and 64 extend downwardly through the opening 58 formed in the bottom panel 36 and cross each other below the opening 58 as seen best in FIG. 4. Therefore, the crossed straps 62 and 64 form a cup shaped pocket 66 in which the bottom end 56 of the elongated tube 52 is positioned. Referring again to FIG. 5, it will be seen that the straps 62 and 64 each have a width dimension that is less than the diameter of the opening 58 formed in the bottom panel 36 so that there are four separate openings 68 in the pocket 66 formed by the crossed straps 62, 64.

Figure 6:
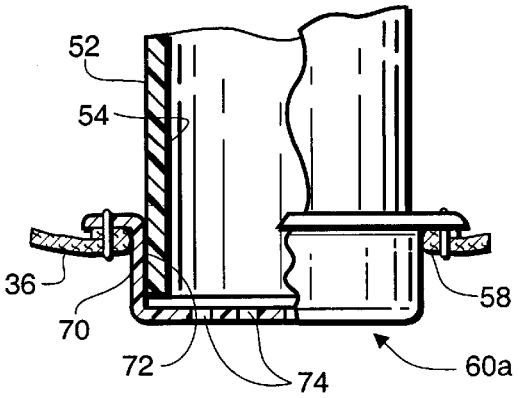
FIG. 6 is a fragmentary sectional view similar to FIG. 4 and partially broken away to show the features of another configuration of baffle means located in the bottom of the putter storage compartment.
Figure 7:
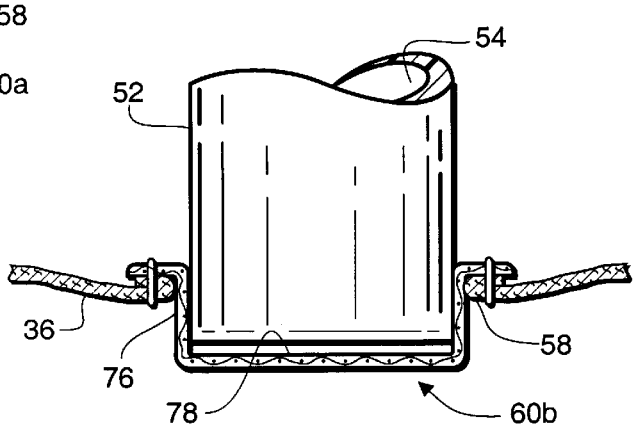
FIG. 7 is a view similar to FIG. 6 showing a further configuration of baffle means.
Figure 8:
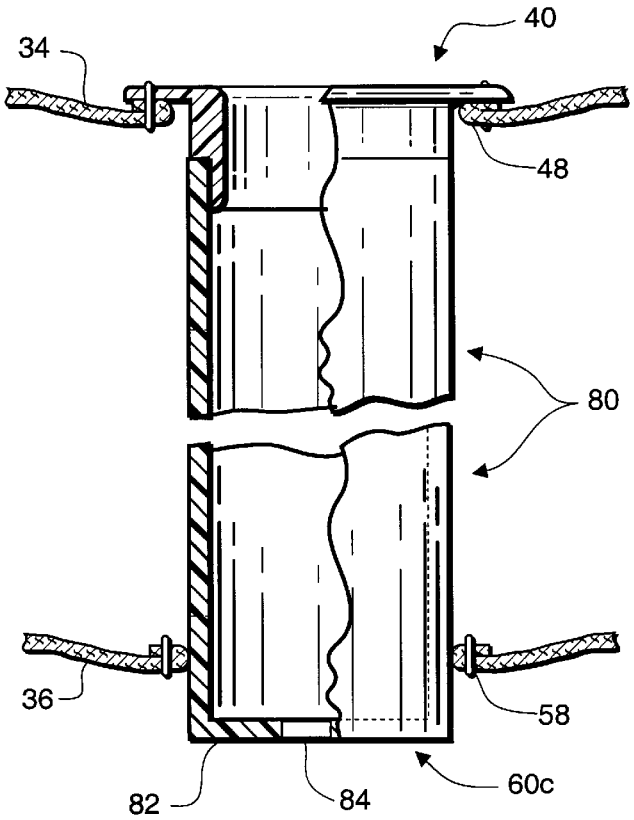
FIG. 8 is a view similar to FIG. 6 showing another configuration of baffle means.
Figure 10:
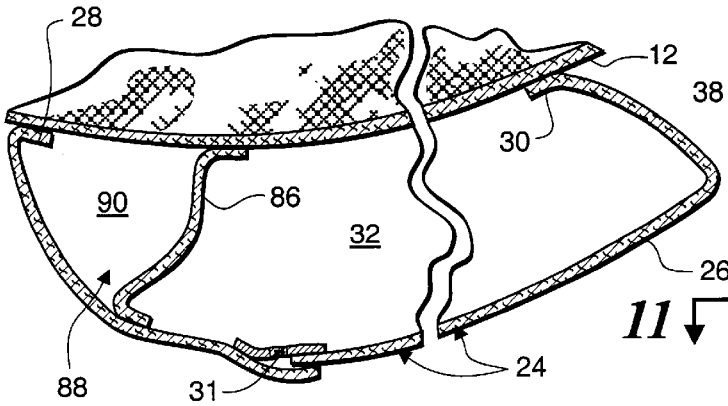
FIG. 10 is an enlarged fragmentary sectional view taken along the line 10—10 of FIG. 9.

While the above-described crossed straps 62 and 64 are the preferred form of the baffle means 60, it will be understood that other devices could be used to partially obstruct the otherwise open bottom end of the putter storage compartment 38. Another configuration of baffle means **60*a* is shown in FIG. 6 as a rigid plate 70 shaped to provide a desired cup shaped pocket 72 with suitable holes 74 formed through the bottom of the pocket 72. This baffle means 60*a* can be formed of any suitable material such as synthetic resin and mounted in the opening 58 provided in the bottom panel 36 of the clothing pocket 24 such as by sewing. A further configuration baffle means 60*b* is shown in FIG. 7 in the form of a relatively large mesh screen 76 such as of wire and suitably shaped to provide a cup shaped pocket 78. A still further configuration of baffle means is identified as 60*c* in FIG. 8. In this FIG. 8 configuration, a modified elongated tube 80 is provided with a bottom plate 82 having a suitable hole 84 formed therein which is molded or otherwise provided in the bottom of the tube 80 to form the baffle 60*c* as an integral part of the tube 80. The top end of the modified tube 80 is fixedly attached to the top fitting 40 such as by a suitable adhesive so that it is dependingly supported by the top fitting 40**.

It will be understood that any of the above described baffle means 60, **60*a*, 60*b*, and 60*c* will accomplish two separate functions. First, they will keep the grip end of the putter shaft (not shown) from extending below the open lower end 56 of the tube 50; and second, they will serve as a drain for any water that may enter into the putter storage compartment 38 through the open top fitting 40. The baffle means 60, 60*a*, and 60*b* will also accomplish a third function in that they support the elongated tube 52 and hold it in the desired orientation within the clothing pocket 24**.

Referring again to FIG. 2, wherein the elongated tube 52 of the putter storage compartment 38 is best seen as being located in the comer 33 formed where the side edge 28 of the side panel 26 of the pocket 24 is attached to the tubular body 12. A partition 86 formed of a suitable material, such as cloth or vinyl, is preferably attached to the tubular body 12 and the side panel 26 so as to isolate the comer 33 containing the putter storage compartment 38 from the rest of the interior storage area 32 of the clothing pocket 24. The partition 86 prevents the elongated tube 52 of the putter storage compartment 38 from becoming entangled with whatever articles the golfer may put into the clothing pocket 24.

Figure 9:
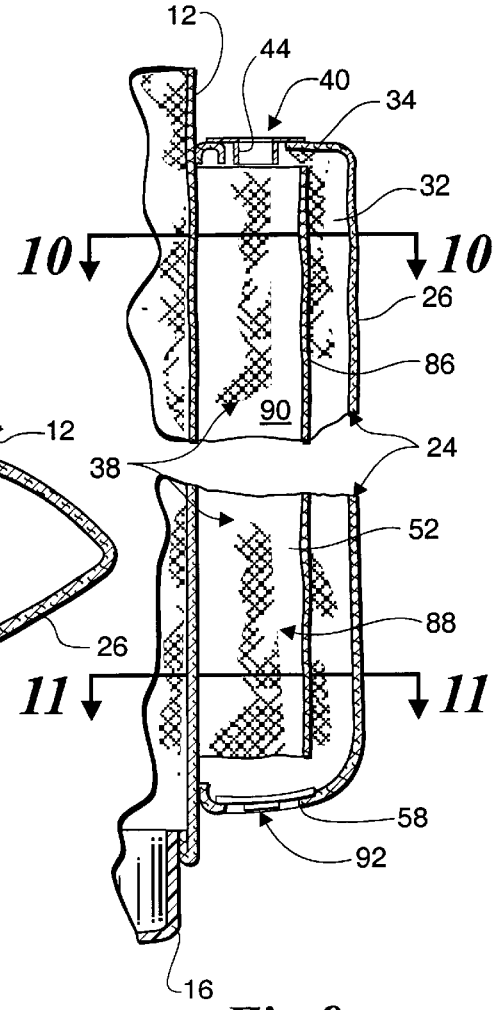
FIG. 9 is a fragmentary sectional view similar to FIG. 2 and showing another embodiment of a putter storage compartment according to the present invention.
Figure 11:
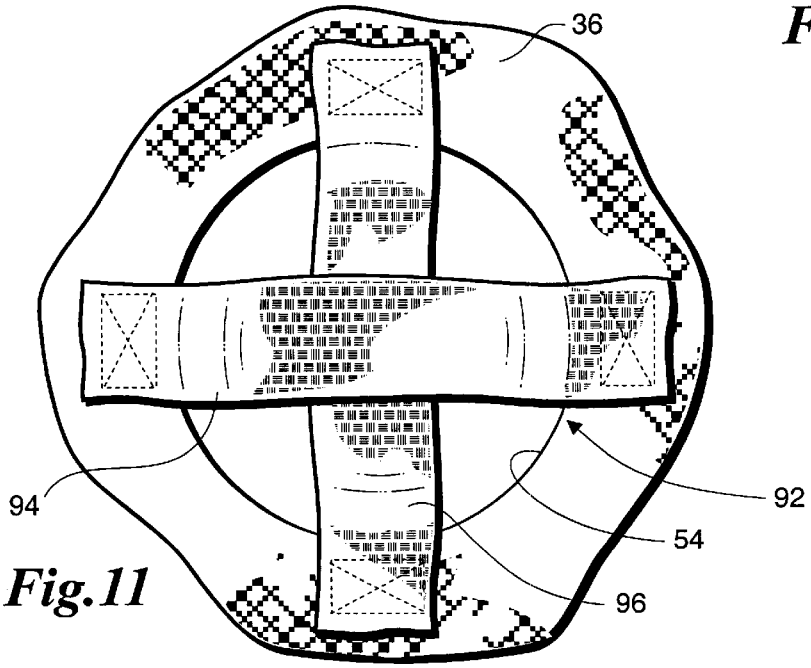
FIG. 11 is an enlarged fragmentary sectional view taken along the line 11—11 of FIG. 9 and showing one configuration of the baffle means used in this embodiment.
Figure 12:
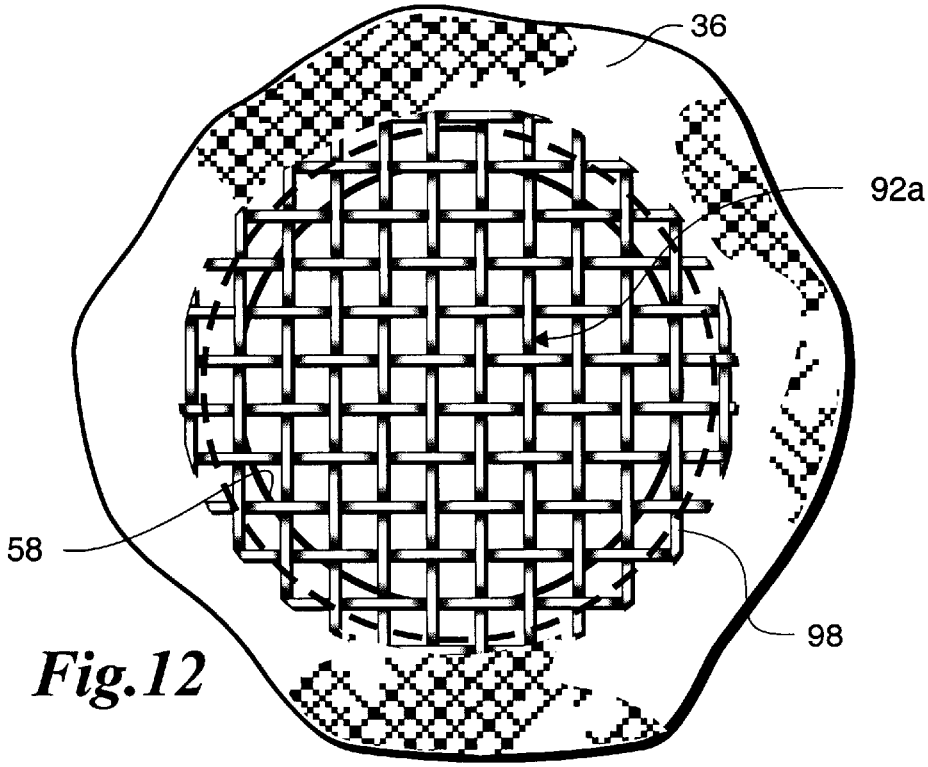
FIG. 12 is a view similar to FIG. 11 showing another configuration of baffle means.
Figure 13:
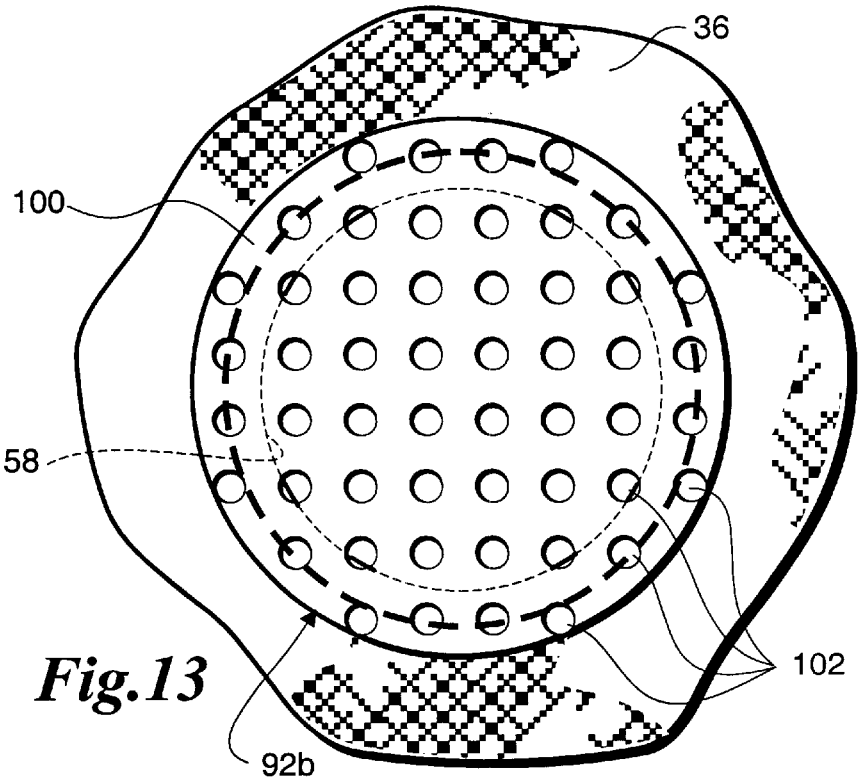
FIG. 13 is a view similar to FIG. 11 showing a further configuration of baffle means.

Reference is now made to FIG. 9, wherein another embodiment of the putter storage compartment is indicated generally by reference numeral 88. In this embodiment which does not utilize the elongated tube 52, the top fitting 40 opens upwardly onto the top panel 34 of the clothing pocket 24 as in the putter storage compartment 38 and opens downwardly into an open space 90 which is located in a comer of the interior storage area 32 adjacent side edge 28 of the side panel 26 of the clothing pocket 24. The space 90 is defined by the partition 86. Baffle means 92 shown in FIG. 11 is mounted above the bottom opening 58 provided in the bottom panel 36 of the clothing pocket 24 and includes two straps 94 and 96 in the cruciform configuration as described in reference to baffle means 60. Since the elongated tube 52 is not used in the putter storage compartment 88, the baffle means 92 differs from the baffle means 60 in that it is of planar configuration without the cup shaped pocket 66. Baffle means 92*a* shown in FIG. 12 is in the form of an open mesh screen 98 of planar configuration and baffle means 92*b* shown in FIG. 13 is in the form of a flat plate 100 having holes 102 formed therethrough.

What is claimed is:

1. A golf bag comprising:

an elongated body defining a main storage compartment for holding a plurality of golf clubs, said elongated body having an open top and a closed bottom;

an elongated pocket attached to said elongated body along one side thereof and extending from proximate the open top thereof to proximate the closed bottom thereof, said elongated pocket having a top panel with an opening formed therein and a bottom panel with an opening formed therein, said elongated pocket defining an interior storage area; and an auxiliary storage compartment for holding a golf putter, said auxiliary storage compartment being located in the interior storage area of said elongated pocket and extending between the openings formed in the top and bottom panels thereof.

2. The golf bag of claim 1, wherein said auxiliary storage compartment is located in a corner of the interior storage area of said elongated pocket and is isolated by a partition.

3. The golf bag of claim 1, further comprising said auxiliary storage compartment having an open bottom end and baffle means in the opening formed in the bottom panel of said elongated pocket for partially obstructing the open bottom end of said auxiliary storage compartment.

4. The golf bag of claim 3, wherein said baffle means comprises a pair of straps arranged in a substantially planar cruciform array across the opening formed in the bottom panel of said elongated pocket, each of said pair of straps having a width dimension that is less than the diameter of the opening formed in the bottom panel of said elongated pocket.

5. The golf bag of claim 3, wherein said baffle means comprises a pair of straps arranged in a cruciform array across the opening formed in the bottom panel of said elongated pocket, each of said pair of straps having a width dimension that is less than the diameter of the opening formed in the bottom panel of said elongated pocket with said pair of straps depending through the opening formed in the bottom panel of said elongated pocket to provide said baffle means with a cup shaped pocket.

6. The golf bag of claim 3, wherein said baffle means comprises an open mesh screen of planar configuration.

7. The golf bag of claim 3, wherein said baffle means comprises an open mesh screen and is formed with a center portion that depends through the opening formed in the bottom panel of said elongated pocket to provide said baffle means with a centrally located cup shaped pocket.

8. The golf bag of claim 3, wherein said baffle means comprises a rigid plate having at least one hole formed therethrough.

9. The golf bag of claim 3, wherein said baffle means comprises a rigid plate having a centrally located cup shaped pocket with at least one hole formed therein with the cup shaped pocket extending through the opening formed in the bottom panel of said elongated pocket.

10. The golf bag of claim 1, wherein said auxiliary storage compartment comprises:

a top fitting mounted in the opening formed in the top panel of said elongated pocket and defining an axial bore which opens onto the top panel of said elongated pocket;

an elongated tube defining an axial bore, said elongated tube fixedly attached to said top fitting so as to depend coaxially from said top fitting to the bottom panel of said elongated pocket and extend through the opening formed in the bottom panel of said elongated pocket; and a perforated plate within a bottom end of said elongated tube to provide a baffle for partially restricting a lower end of said axial bore.

11. The golf bag of claim 1, wherein said auxiliary storage compartment comprises:

a top fitting mounted in the opening formed in the top panel of said elongated pocket and defining an axial bore which opens onto the top panel of said elongated pocket;

an elongated tube defining an axial bore, said elongated tube attached to said top fitting so as to extend coaxially from said top fitting to the bottom panel of said elongated pocket and extend through the opening formed in the bottom panel of said elongated pocket to form an open bottom end in said auxiliary storage compartment; and baffle means in the opening formed in the bottom panel of said elongated pocket for partially obstructing the open bottom end of said auxiliary storage compartment.

12. The golf bag of claim 11, wherein said baffle means comprises a pair of straps arranged in a cruciform array in the opening formed in the bottom panel of said elongated pocket, the opposite ends of each of said pair of straps are affixed to the interior surface of the bottom panel of the said elongated pocket with said straps depending through the opening formed in the bottom panel of said elongated pocket for nestingly containing a bottom end of said elongated tube.

13. The golf bag of claim 11, wherein said baffle means comprises an open mesh screen which is formed with a center portion that depends through the opening formed in the bottom panel of said elongated pocket to provide said baffle means with a centrally located cup shaped pocket for nestingly containing a bottom end of said elongated tube.

14. The golf bag of claim 11, wherein said baffle means comprises a rigid plate having a centrally located cup shaped pocket with at least one hole formed therein with the cup shaped pocket extending through the opening formed in the bottom panel of said elongated pocket for nestingly containing a bottom end of said elongated tube.

15. A golf bag comprising:

an elongated body for holding a plurality of golf clubs and having a top and a bottom;

an elongated pocket attached to the elongated body along one side thereof and extending from proximate the top thereof to proximate the bottom thereof, said elongated pocket having a top panel with an opening formed therein and a bottom panel with an opening formed therein; and a partition within said elongated pocket extending from the top panel to the bottom panel thereof to separate said elongated pocket into an interior storage area and a putter storage compartment with the putter storage compartment extending between the opening formed in the top panel and the opening formed in the bottom panel of said elongated pocket.

16. The golf bag of claim 15, further comprising a top fitting mounted in the top panel opening of said elongated pocket and defining an axial bore.

17. The golf bag of claim 15, further comprising baffle means in the bottom panel opening of said elongated pocket for partially restricting the bottom panel opening.

18. The golf bag of claim 17, wherein said baffle means comprises a pair of straps arranged in a substantially planar cruciform array across the opening formed in the bottom panel of said elongated pocket, each of said pair of straps having a width dimension that is less than the diameter of the opening formed in the bottom panel of said pocket.

19. The golf bag of claim 17, wherein said baffle means comprises an open mesh screen of planar configuration.

20. The golf bag of claim 17, wherein said baffle means comprises a rigid plate of planar configuration with at least one hole formed there through.

21. The golf bag of claim 15, further comprising an elongated tube within the putter storage compartment of said elongated pocket and extending between the top and bottom panel openings formed in said elongated pocket.

22. The golf bag of claim 21, further comprising baffle means in the bottom panel opening of said elongated pocket for partially restricting the bottom panel opening.

23. The golf bag of claim 22, wherein said baffle means comprises a pair of straps arranged in a cruciform array across the opening formed in the bottom panel of said elongated pocket, each of said pair of straps having a width dimension that is less than the diameter of the opening formed in the bottom panel of said elongated pocket with said pair of straps depending through the opening formed in the bottom panel of said elongated pocket to provide said baffle means with a cup shaped pocket in which a bottom end of said elongated tube is nestingly disposed.

24. The golf bag of claim 22, wherein said baffle means comprises an open mesh screen which is formed with a center portion that depends through the opening formed in the bottom panel of said elongated pocket to provide said baffle means with a centrally located cup shaped pocket in which a bottom end of said elongated tube is nestingly disposed.

25. The golf bag of claim 22, wherein said baffle means comprises a rigid plate having a centrally located cup shaped pocket with at least one hole formed therein with the cup shaped pocket extending through the opening formed in the bottom panel of said elongated pocket and having a bottom end of said elongated tube nestingly disposed therein.

26. The golf bag of claim 15, wherein the putter storage compartment provided in said elongated pocket comprises:

a top fitting mounted in the opening formed in the top panel of said elongated pocket and defining an axial bore which opens onto the top panel of said elongated pocket;

an elongated tube defining an axial bore, said elongated tube fixedly attached to said top fitting so as to depend coaxially from said top fitting to the bottom panel of said elongated pocket and extend through the opening formed in the bottom panel of said elongated pocket; and a perforated plate within the lower end of said elongated tube to provide a baffle for partially obstructing a bottom end of the axial bore of said elongated tube.

* * * * *